US008671893B2

(12) United States Patent
Popp et al.

(10) Patent No.: US 8,671,893 B2
(45) Date of Patent: Mar. 18, 2014

(54) ACTUATING MECHANISM TO REGULATE A CONTROLLABLE COOLANT PUMP

(75) Inventors: Markus Popp, Bamberg (DE); Sebastian Hurst, Bubenreuth (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 141 days.

(21) Appl. No.: 13/403,244

(22) Filed: Feb. 23, 2012

(65) Prior Publication Data

US 2012/0291724 A1 Nov. 22, 2012

(30) Foreign Application Priority Data

May 19, 2011 (DE) ..... 10 2011 176138

(51) Int. Cl.
*F01P 5/10* (2006.01)
*F03B 1/02* (2006.01)

(52) U.S. Cl.
USPC ..... 123/41.44; 415/131

(58) Field of Classification Search
USPC ..... 123/41.44, 41.47; 415/131, 140
See application file for complete search history.

(56) References Cited

U.S. PATENT DOCUMENTS 6,669,439 B2 * 12/2003 Kardasz et al. ..... 415/131

FOREIGN PATENT DOCUMENTS

| | | |
|---|---|---|
| DE | 19901123 | 7/2000 |
| DE | 10057098 | 3/2002 |
| DE | 102005062200 | 2/2007 |
| DE | 102005004315 | 4/2007 |

* cited by examiner

*Primary Examiner* — Noah Kamen
(74) *Attorney, Agent, or Firm* — Volpe and Koenig, P.C.

(57) ABSTRACT

A controllable coolant pump, insertable in a coolant circuit of an internal combustion engine includes a pump housing, in which a hollow pump shaft is supported rotationally with an allocated impeller. Rotation of the impeller conveys coolant. To control a volume conveyed by the coolant pump an axially displaceable guide disk is provided, allocated to the impeller and cooperating with an actuating mechanism. The guide disk is connected to a push rod, guided in the pump shaft, and is displaceable between two end positions defined by a rear wall and a pump cover of the impeller. The actuating mechanism further includes a displacement pump integrated in the coolant pump, with a coolant flow of the displacement pump being supplied for adjustment of the guide disk via a control valve to an actuator, which includes a piston in a pressure chamber in the pump shaft connected to the push rod.

10 Claims, 3 Drawing Sheets

ACTUATING MECHANISM TO REGULATE A CONTROLLABLE COOLANT PUMP

CROSS-REFERENCE TO RELATED APPLICATIONS

This application claims the benefit of German Patent Application No. 102011076138.1, filed May 19, 2011, which is incorporated herein by reference as if fully set forth.

BACKGROUND

The invention relates to a controllable coolant pump, particularly for a coolant circuit of an internal combustion engine. The design of the radial pump comprises a pump housing, in which a pump shaft embodied as a hollow shaft with a corresponding impeller is supported in a rotational fashion. In the operating state coolant is conveyed during the rotation of the impeller via a suction connection into a spiral port of the coolant pump. In order to influence the volume conveyed an axially displaceable guide disk is provided, cooperating with an actuating e mechanism and/or actuators or an adjustment unit and allocated to the impeller, which is connected to a push rod, guided in a rotary fixed manner in the hollow shaft and displaceable between two end positions of a rear wall and a pump cover of the impeller.

In vehicles, preferably water-cooled internal combustion engines have proven effective. Here, in order to cool the internal combustion engine a coolant, particularly cooling water is pumped with the help of a coolant pump in a closed circuit via cooling channels of the engine block and the cylinder head and subsequently guided into an air-water heat exchanger and/or radiator, where the heated coolant is cooled back by airflow or by a fan when the vehicle is stationary. The coolant pump supporting the circulation of the coolant is usually driven directly via a traction drive, particularly a belt drive, with a traction element connecting the belt pulley of the crank shaft to the coolant pump.

This drive between the coolant pump and the crank shaft causes a dependency of the rotation of the pump on the rotation of the internal combustion engine. This leads to the consequence that coolant already circulates during cold starts of the internal combustion engine, which hinders the warm-up of the internal combustion engine, and thus the reaching of an optimal operating temperature as fast as possible is delayed. Due to this fact, controllable coolant pumps are used, in which the volume flow conveyed can be adjusted according to the cooling need of the internal combustion engine. This way, loss by friction can be minimized, because with increasing oil temperature the viscosity of the lubricating oil and consequently the friction is reduced, which has beneficial effects on the fuel consumption. Simultaneously, improved exhaust emissions are yielded, because the effectiveness of the catalytic converter requires a minimum exhaust temperature and a reduced period of time to reaching said temperature has directly positive effects on the exhaust emissions. Vehicle manufacturers request in the cold-operating phase of the internal combustion engine a coolant flow of the coolant pump of ≤0.5 l/h, also called "zero leakage flow". Under test conditions, fuel savings of ≥2.5% could be realized by the development of internal combustion engines in order to yield an energetically and thermo-mechanically improved operation in connection with an optimal thermal management.

From DE 199 01 123 A1 a measure is known to influence the volume conveyed by a coolant pump, comprising a slider allocated to the open impeller covering the blades of the impeller and influencing the effective width of the blades, which is continuously movable in the axial direction and can be arbitrarily adjusted. The adjustment of the slider between an opening and a closing position occurs here by rotating a thread-like guidance. According to DE 100 57 098 A1 a controllable coolant pump comprises a magnetic coil cooperating with an anchor plate, which is arranged in a rotary fixed but spring-loaded displaceable manner on a drive shaft. When the magnet is not electrified, the drive of the impeller occurs due to the friction coatings, by which the impeller is connected to the anchor plate.

DE 100 2005 004 315 A1 as well as DE 10 2005 062 200 A1 show coolant pumps, in which in order to influence the volume conveyed the pump housing one annularly embodied valve slider is inserted, supported displaceable in the direction of the shaft axis of the pump shaft, which includes an exterior cylinder, for variably covering the outflow area of the impeller. According to DE 10 2005 004 315 A1 the valve slider, also called guide disk, is adjusted electro-magnetically via a magnetic coil arranged in the pump housing. Alternatively, DE 10 2005 062 200 A1 includes an actuator, operated pneumatically or hydraulically, in order to adjust the valve slider.

SUMMARY

The invention is based on the objective of providing a controllable coolant pump, which includes spatially and cost-optimized actuating mechanism, integrated in the pump housing, and a fail-safe device for a reliable operation of the guide disk or the valve slider.

This objective is attained according to the invention, with advantageous embodiments of the invention being described below and in the claims.

According to the invention, the actuating mechanism, also called actuators, comprise a displacement pump, an actuator engaging a regulating system in a controlling fashion, actors or converters, as well as a control valve. The displacement pump integrated in the pump housing of the coolant pump in connection with a control valve and the actuator allows a continuous adjustment of the guide disk to different positions. For this purpose, a coolant flow of the displacement pump can be adjusted via the control valve to the respective needs, precisely measured, and guided to the actuator embodied as a piston-cylinder unit. The actuator forms a pressure chamber inserted into the pump shaft, in which a piston is guided connected to the push rod, which is positioned at the end of the push rod facing away from the guide disk.

Contrary to the solutions of prior art, the invention comprises an actuating device based on hydraulic pressure, with for the creation of the hydraulic pressure the displacement pump integrated in the coolant pump compresses the coolant. Different from solutions of prior art, in which the hydraulic oil of the internal combustion engine adjusts the guide disk, the coolant used for actuating according to the invention creates an independently created hydraulic pressure. This less critical actuating energy requires no additional hydraulic connections, for example between the internal combustion engine and the pump housing nor any increased sealing expense in order to effectively prevent any oil from entering the coolant of the internal combustion engine. The measure according to the invention advantageously realizes lastingly a precise adjustment of the guide disk, in order to achieve for example a rapid heating of the internal combustion engine after a cold start. During permanent operation of the internal combustion engine the actuating mechanism allows a demand-controlled, targeted influencing of the amount conveyed by the coolant pump, by which the precise control of the temperature of the internal combustion engine can be yielded. Connected thereto, a reduction of exhaust emissions, friction loss, and fuel consumption occurs over the entire operating range of the internal combustion engine.

In order to adjust the flow of coolant or the volume flow of the coolant pump, the guide disk or the guiding plate is axially displaced in reference to the impeller by the actuator. A cylindrical pressure chamber is provided in the pump shaft as the actuator, in which the piston of the push rod, fixed at one end of the push rod, can be linearly displaced and guided in a sealed fashion. For this purpose, the pump shaft is provided with hollow bores like blind holes at the side of the impeller blades, and forms a recess, which together with the piston limits the compression chamber. At the other end of the push rod, the guide disk or the guide plate is fastened, for example, via an interference fit assembly. Advantageously the actuating mechanism provided for the adjustment of the guide disk in the axial direction can be used, which is inserted in the coolant pump in a neutral manner with regards to design space, which therefore requires no adjustment of the ambient construction, for example the drive of the coolant pump. The actuator according to the invention can further be integrated inside the axial packaging limits of conventionally designed coolant pumps, comprising a belt disk, bearing, gliding ring gasket, and impeller. Additionally, the concept of the actuating mechanism according to the invention allows an integrated assembly of all components, combined with a compact, simple and robust design with regards to production and assembly, which can be cost-effectively standardized for differently sized coolant pumps. The actuating mechanism intended for an active control of the amounts of coolant conveyed is additionally characterized in a higher operational safety and reliability as well as a high volumetric effectiveness. The actuating mechanism according to the invention can beneficially be implemented with little production and assembly expenses and thus in a cost-effective manner. Additionally, a conventional coolant pump can be directly exchanged for a coolant pump equipped with the actuating mechanism according to the invention.

Additional features and advantages of the invention are discernible from the claims, the drawings, and the corresponding description of the figures.

A preferred embodiment of the invention comprises using a gear pump as the displacement pump, with its driving gear advantageously being connected in a torque-proof manner to the pump shaft and with its driven gear being directly supported in a rotational fashion in the pump housing or indirectly via a separate housing, intended to receive the displacement pump. The two toothed gears of the suction and the pressure connection rotating in opposite directions including the displacement pump, embodied as a gear pump, engage each other at the suction side of the pump, with the hydraulic fluid entering free and/or open tooth gaps of the toothed gears and by the rotation each being conveyed via the area enclosed by the pump housing into the pressure connection. Due to the toothed engagement of the two toothed gears occurring here, the hydraulic fluid is pressed out of the tooth gaps into the pressure connection of the pump. Instead of a gear pump, other displacement or conveyer pumps can also be used, which can be integrated into the coolant pump in order to adjust the guide disk. As a measure to simplify the assembly the invention includes a displacement pump, which can be inserted as a pre-assembled component into the pump housing of the coolant pump. Advantageously the displacement pump, comprising all components, being pre-assembled, and particularly embodied as a gear pump, is assembled automatically in a cost-optimized fashion.

Further, the actuating mechanism according to the invention include a switching valve, which is allocated to a pressure line, connecting a pressure side of the displacement pump to the pressure chamber of the pump shaft. For example, a bore in a wall of the pump housing or alternatively a separate hydraulic line can be used as a pressure line.

In order to pressurize the pressure chamber, to ensure an actuating motion of the piston and the guide plate connected thereto, a preferred design comprises a displacement pump with an end face cover, forming a receptacle encasing the pump shaft, in which an annular groove is provided in the interior. The annular groove is connected via the pressure line to the displacement pump and further via radial openings, particularly bores in the pump shaft, to the pressure chamber. This way, the pressure created in the displacement pump and/or the coolant flow can be fed via the pressure line into the annular groove of the receptacle and subsequently via radial openings of the pump shaft directly to the pressure chamber of the pump shaft.

Further, the control valve directly connected to the pressure line can be positioned as a component in the coolant pump or outside the coolant pump, by which a coolant flow and/or its pressure potential is forwarded depending on the adjustment needed to the actuator and thus to the piston of the push rod. Independent from the adjustment position electrically, magnetically, pneumatically, or hydraulically operated control valves can be used, by which the hydraulically acting actuators can be activated. In the operating state, the control valve is preferably addressed by a control and/or a motor management of the internal combustion engine.

In order to yield lasting actuator functions, the push rod allocated to the control plate and the piston is guided in the pressure chamber of the pump shaft. Suitable for this purpose is a guide element, for example, inserted in a fixed manner in the end section of the pressure chamber at the side of the impeller, which preferably simultaneously performs a sealing function.

As a measure to ensure continued function of the coolant pump and thus the cooling of the internal combustion engine in case of the actuating mechanism failing, the actuating mechanism includes a failsafe device and/or a failsafe coupling. It comprises a device integrated in the actuator, which preferably comprises a spring element partially covering the push rod, and supported between the displaceable piston and a locally fixed component of the pump shaft or the guide element. In case of failure or loss of pressure of the displacement pump, the spring element causes an automatic adjustment of the piston and thus the guide plate into a position which is equivalent to a maximum opening of the impeller leading to the maximum volume conveyed by the coolant pump.

The above-described features are not only useful in the combination described by also in any other combination or in a stand-alone arrangement without departing from the scope of the present invention.

BRIEF DESCRIPTION OF THE DRAWINGS

Additional features of the invention are discernible from the following description, showing a preferred exemplary embodiment of the invention.

In the Figures.

DETAILED DESCRIPTION OF THE PREFERRED EMBODIMENTS

Figure 1:
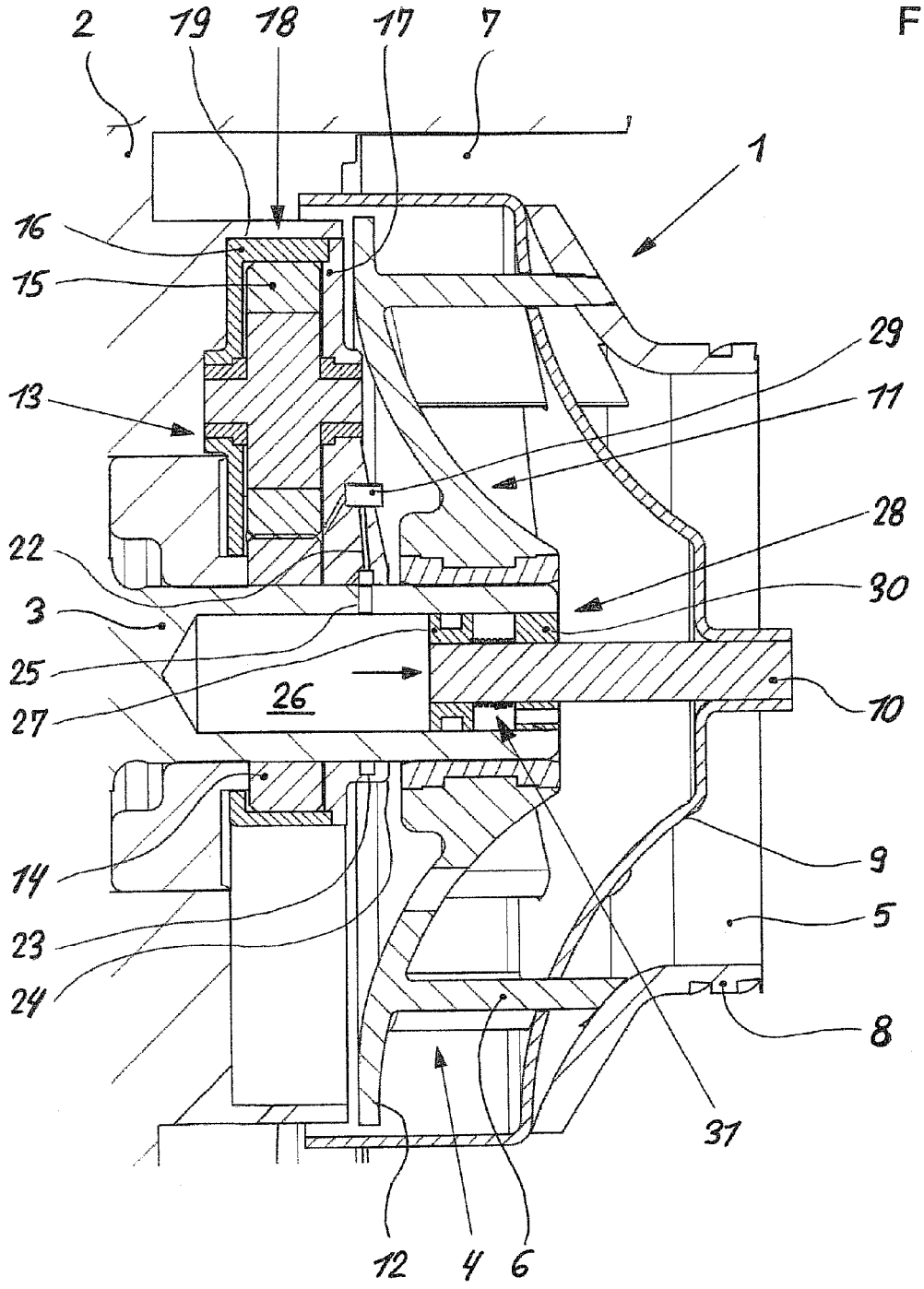
FIG. 1 is a longitudinal cross-section through a controllable coolant pump according to the invention.

FIG. 1 shows a controllable coolant pump 1 in a longitudinal cross-section, comprising a pump housing 2, in which a pump shaft 3 is supported, embodied as a hollow shaft, connected in a torque-proof fashion to an impeller. When the impeller 4 rotates in the operating state of the coolant pump 1 coolant, particularly cooling water, flows via a suction connector 5 to the impeller 4 and is radially guided via blades 6 into a spiral port 7. Here, a pump cover 8 connected to the impeller 4 forms a transfer to the suction connection 5. In order to influence the volume conveyed by the coolant pump 1 a guide disk 9 is provided, axially displaceable and variably covering an outflow area of the impeller 4, which is fixed in a torque-proof fashion at a push rod 10 displaceable in reference to the pump shaft 3. Using actuating mechanism 11, also called control unit, or actuators, the guide disk 9 can be continuously positioned between two end positions defined by the pump cover 8 and a rear wall 12. According to FIG. 1, the guide disk 9 is supported on the pump cover 8, by which a closed impeller 4 and thus a zero conveyance of the coolant pump 1 develops. The actuating mechanism 11 comprises a displacement pump 13, integrated inside the coolant pump 1 and embodied as a gear pump, with the driving gear 14 being connected to the pump shaft 3 in a torque-proof fashion and engaging a driven gear 15, which is directly supported radially off-set in the pump housing 2 in a rotary fashion. The gears 14, 15 of the displacement pump 13 as well as an allocated housing 16 and an end face cover 17 jointly form a pre-assembled displacement pump 13, the component 18, which can be inserted axially into a corresponding recess 19 of the pump housing 2.

Figure 2:
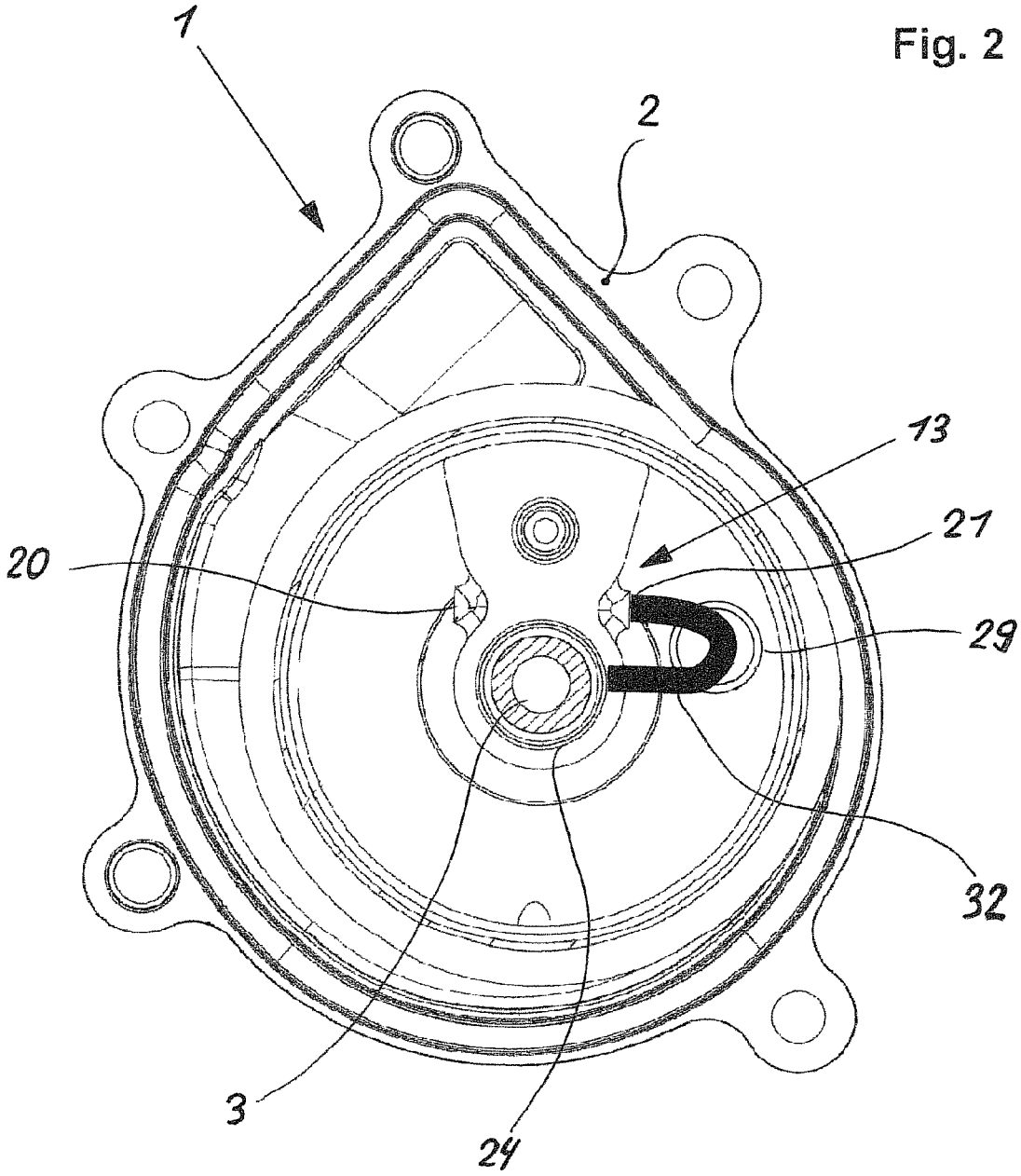
FIG. 2 is a detail view of the coolant pump according to FIG. 1.

In the operating state of the coolant pump 1, coolant flows via a suction side 20, shown in FIG. 2, into the displacement pump 13 and is guided from a pressure side 21 into a pressure line 22 (FIG. 1) or 32 (FIG. 2) of the cover 17, mounted in an annular groove 23 of a recess 24 of the cover 17 encasing the pump shaft 3. The annular groove 23 is connected via radially aligned openings 25, particularly bores, to a pressure chamber 26 of the pump shaft 2. The pressure chamber 26 together with a piston 27 guided therein, which is connected via the push rod 10 to the guide disk 9, form an actuator 28 of the actuating mechanism 11. Through the use of a control valve 29, allocated to the pressure line 22, depending on requirements the pressure chamber 26 can be impinged with coolant in order to adjust the piston 27 including the guide disk 9 in the direction of the arrow. The control valve 29, for example addressed electronically, is preferably connected to a control of the internal combustion engine, not shown in FIG. 1, thus realizing a direct dependency of the operating temperature of the internal combustion engine or considering additional parameters of the respectively required coolant flow via the appropriately adjusted guide disk 9. The push rod 10 is guided inside the pressure chamber 26 in a guiding element 30. A failsafe device 31 is provided in order to ensure the function of the coolant pump 1 when the actuating mechanism 11 fails. For this purpose, a spring element is provided, particularly a compression spring inserted between the guide element 30 and the piston 27, which in case of falling pressure inside the pressure chamber 26 automatically displaces the piston 27 in the direction opposite the arrow up to a stop of the guide disk 9 at the rear wall 12, by which a maximum opening of the impeller 4 develops.

FIG. 2 shows particularly the position of installation of the displacement pump 13 inside the coolant pump 1. The coolant flows via the suction side 20 and thus the suction connection into the displacement pump 13. Alternatively to FIG. 1, a connection is provided as a separate component between the pressure side 21 of the displacement pump 13 and the receptacle 24 in the cover 17 as the pressure line 32. The pressure line 32, preferably embodied as a pipe, is connected to the control valve 29.

Figure 3:
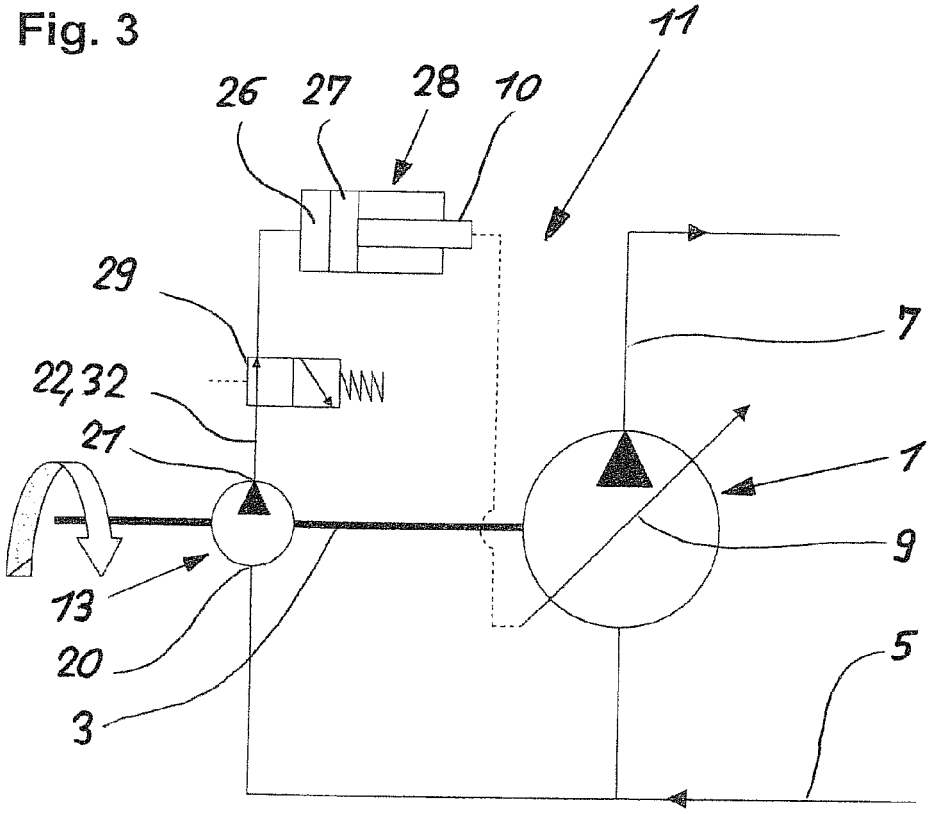
FIG. 3 is a schematic design of the actuating mechanism according to the invention of the controlled coolant pump.

FIG. 3 shows the design of the actuating mechanism 11 according to the invention by a schematic illustration, with all components being displayed separated from the coolant pump 1. A partial amount of the coolant flowing via the suction connection 5 into the coolant pump 1 passes via the suction side 20 into the displacement pump 13 and is guided at the pressure side into the pressure line 22 or 32 to the control valve 29 and subsequently to the pressure chamber 26 of the actuator 28. Here, pressurization of the piston 27 occurs, with its actuating motion being transferred to a guide disk 9, which directly influences the volume conveyed by the coolant pump 1.

LIST OF REFERENCE CHARACTERS

1 coolant pump
2 pump housing
3 pump shaft
4 impeller
5 suction connection
6 blade
7 spiral port
8 pump cover
9 guide disk
10 push rod
11 actuating mechanism
12 rear wall
13 displacement pump
14 gear (driving)
15 gear (driven)
16 housing
17 cover
18 component
19 recess
20 suction side
21 pressure side
22 pressure line
23 annular groove
24 receptacle
25 opening
26 pressure chamber
27 piston
28 actuator
29 control valve
30 guide element
31 failsafe device
32 pressure line

The invention claimed is:

1. A controllable coolant pump for a cooling circuit of an internal combustion engine, comprising a pump housing, in which a pump shaft embodied as a hollow shaft is rotationally supported with an allocated impeller, a rotation of the impeller conveying a coolant via a suction connection into a spiral port of the coolant pump, an axially displaceable guide disk allocated to the impeller in order to influence a volume conveyed that cooperates with an actuating mechanism, and is connected in a torque-proof fashion to a push rod, the guide disk is displaceable between two end positions defined by a rear wall and a pump cover of the impeller and guided on the pump shaft, the actuating mechanism comprises a displacement pump integrated in the coolant pump, with a coolant flow of the displacement pump being fed to an actuator for a continuous adjustment of the guide disk via a control valve, said actuator includes a pressure chamber located in the pump shaft in which a piston connected to the push rod is guided in a displaceable fashion.

2. The controllable coolant pump according to claim 1, wherein a gear pump is provided as the displacement pump, and includes a driving gear connected in a torque-proof fashion to the pump shaft and a driven gear being at least indirectly supported in the pump housing in a rotary fashion.

3. The controllable coolant pump according to claim 1, wherein the displacement pump is inserted as a preassembled component into the pump housing.

4. The controllable coolant pump according to claim 1, wherein the control valve is allocated to a pressure line, which connects a pressure side of the displacement pump to the pressure chamber of the pump shaft.

5. The controllable coolant pump according to claim 4, wherein a bore in the pump housing or a separate line is provided as the pressure line, which extends between the pressure side of the displacement pump and the pressure chamber of the pump shaft.

6. The controllable coolant pump according to claim 1, wherein an end face cover of the displacement pump forms a receptacle encasing the pump shaft having an interior annular groove, which is connected via radial openings of the pump shaft to the pressure chamber as well as via a pressure line to the displacement pump.

7. The controllable coolant pump according to claim 1, wherein the actuator is hydraulically operated and is activatable via an electrically, magnetically, pneumatically, or hydraulically operated control valve.

8. The controllable coolant pump according to claim 7, wherein the control valve is integrated in the coolant pump as a component or positioned outside the coolant pump and is connected to a control of the internal combustion engine.

9. The controllable coolant pump according to claim 1, wherein the push rod connected in one piece with the guide disk of the impeller is guided via a locally fixed guide element inserted in the pressure chamber of the pump shaft.

10. The controllable coolant pump according to claim 1, wherein the actuating mechanism includes a spring element integrated in the actuator as a failsafe device.

* * * * *